US005473126A

United States Patent [19]

Wu

[11] Patent Number: 5,473,126

[45] Date of Patent: Dec. 5, 1995

[54] JOYSTICK SWITCH ASSEMBLY

[76] Inventor: Donald Wu, 12F, No. 59, Chang Chun Road, Taipei, Taiwan

[21] Appl. No.: 188,808

[22] Filed: Jan. 31, 1994

[51] Int. Cl.[6] ..... H01H 25/04

[52] U.S. Cl. ..... 200/64; 200/557

[58] Field of Search ..... 200/5 R, 5 A, 200/6 A, 292, 511, 512–517, 553, 557; 178/18

[56] References Cited

U.S. PATENT DOCUMENTS

| | | | |
|---|---|---|---|
| 4,245,137 | 1/1981 | Hirai et al. | 200/6 A X |
| 4,408,103 | 10/1983 | Smith, III | 200/6 A |
| 4,440,990 | 4/1984 | Nozaki | 200/5 A |
| 4,511,769 | 4/1985 | Sahakian et al. | 200/6 A |
| 4,614,847 | 9/1986 | Sasao | 200/6 A |
| 4,795,862 | 1/1989 | Linden | 200/6 A |
| 5,361,083 | 11/1994 | Pollack | 200/6 A X |

*Primary Examiner*—J. R. Scott
*Attorney, Agent, or Firm*—Jacobson, Price, Holman & Stern

[57] ABSTRACT

A joystick switch assembly includes a U-shaped bottom shell covered with a cover shell, a joystick extending out of the cover shell and having a contact plate at the bottom received within the bottom shell, an upper membrane circuit and a lower membrane circuit mounted on the joystick inside the bottom shell and separated by the contact plate, an upper conductive rubber disposed between the contact plate and the upper membrane circuit, a lower conductive rubber disposed between the contact plate and the lower membrane circuit, wherein the contact plate has two convex portions on two opposite sides thereof. Moving the joystick causes the convex portions to squeeze the conductive rubbers which caused variations in impedances across impedance points on the membrane circuits, and therefore a signal output is varied in proportion to the amount and direction of the movement of the joystick.

3 Claims, 3 Drawing Sheets

JOYSTICK SWITCH ASSEMBLY

BACKGROUND OF THE INVENTION

The present invention relates to an improved structure of joystick switch assembly which has convex portions on two opposite sides of the contact plate of the joystick thereof, wherein when the joystick is moved the convex portions are forced to squeeze a respective conductive rubber to vary a set of impedances defined across respective impedance points on a respective membrane circuit thereby indicating the amount and direction of the movement of the joystick.

A variety of computers are known and widely used in different fields, For full screen editing, a computer system is generally equipped with a joystick for controlling a movement of the cursor on the screen. FIG. 1 shows a joystick switch assembly according to the prior art which is generally comprised of a rubber cap 11, a joystick 12, a cover shell 13, a conductive rubber 14, and a circuit board 15. The joystick 12 comprises a joystick body 121 extending out of the cover shell 13 through a center through-hole 131 in the cover shell 13, and a flat contact plate 122 received within a storage chamber 132 defined within the cover shell 13. The rubber cap 11 covers the top of the joystick body 121. The circuit board 15 is fastened to connecting portions 133 at the bottom of the cover shell 13 by a welding process, and has a plurality of impedance points. The conductive rubber 14 is disposed between the circuit board 15 and the flat contact plate 122 of the joystick 12. When the joystick 12 is moved, the flat contact plate 122 is forced to squeeze the conductive rubber 14 causing variations in the impedance across the respective impedance points on the circuit board. The variations can be used to produce a signal output which is produced proportional to the amount and direction of the movement of the joystick and sent to the mainframe of the computer system to change the position of the cursor on the screen. However, this structure of joystick has drawbacks. Because the contact plate 122 of the joystick 12 is a flat plate, an error contact between the contact plate 122 and the impedance points on the circuit board 15 tends to happen. Therefore, the sensitivity of this structure of joystick is low. Another drawback of this structure of joystick is that the conductive rubber 14 will wear off quickly because of its broad contact area between the contact plate 122 of the joystick 12 and the circuit board 15. Still another drawback associated with this joystick structure is its low sensitivity and low accuracy because there is only one circuit board disposed at one side by the contact plate 122 of the joystick 12 for creating the impedance.

SUMMARY OF THE INVENTION

The present invention has been accomplished to provide an improved joystick switch assembly which eliminates the aforesaid drawbacks.

According to the preferred embodiment of the present invention, the joystick switch assembly comprises a cup-like bottom shell covered with a cover shell, a joystick extended out of the cover shell and having a contact plate at the bottom received within the bottom shell, an upper membrane circuit and a lower membrane circuit mounted on the stick inside the bottom shell and separated by the contact plate, an upper conductive rubber disposed between the contact plate and the upper membrane circuit, and a lower conductive rubber disposed between the contact plate and the lower membrane circuit. The contact plate has two convex portions on two opposite sides thereof. When the joystick is moved, the convex portions are forced to squeeze the upper and lower conductive rubbers to thus vary the impedance across the respective impedance points on the membrane circuits, and therefore modify a signal output in proportion to the amount and direction of the movement of the joystick. Because the membrane circuits have low coefficients of friction, the membrane circuits and the conductive rubbers do not wear off quickly. Even if either conductive rubber is worn by prolonged usage, it will still be effectively squeezed by the respective convex portion of the contact plate to effect the required impedance variations across the induction points on the respective membrane circuit. Therefore, the service life of the joystick is prolonged.

DETAILED DESCRIPTION OF THE PREFERRED EMBODIMENT

Figure 1:
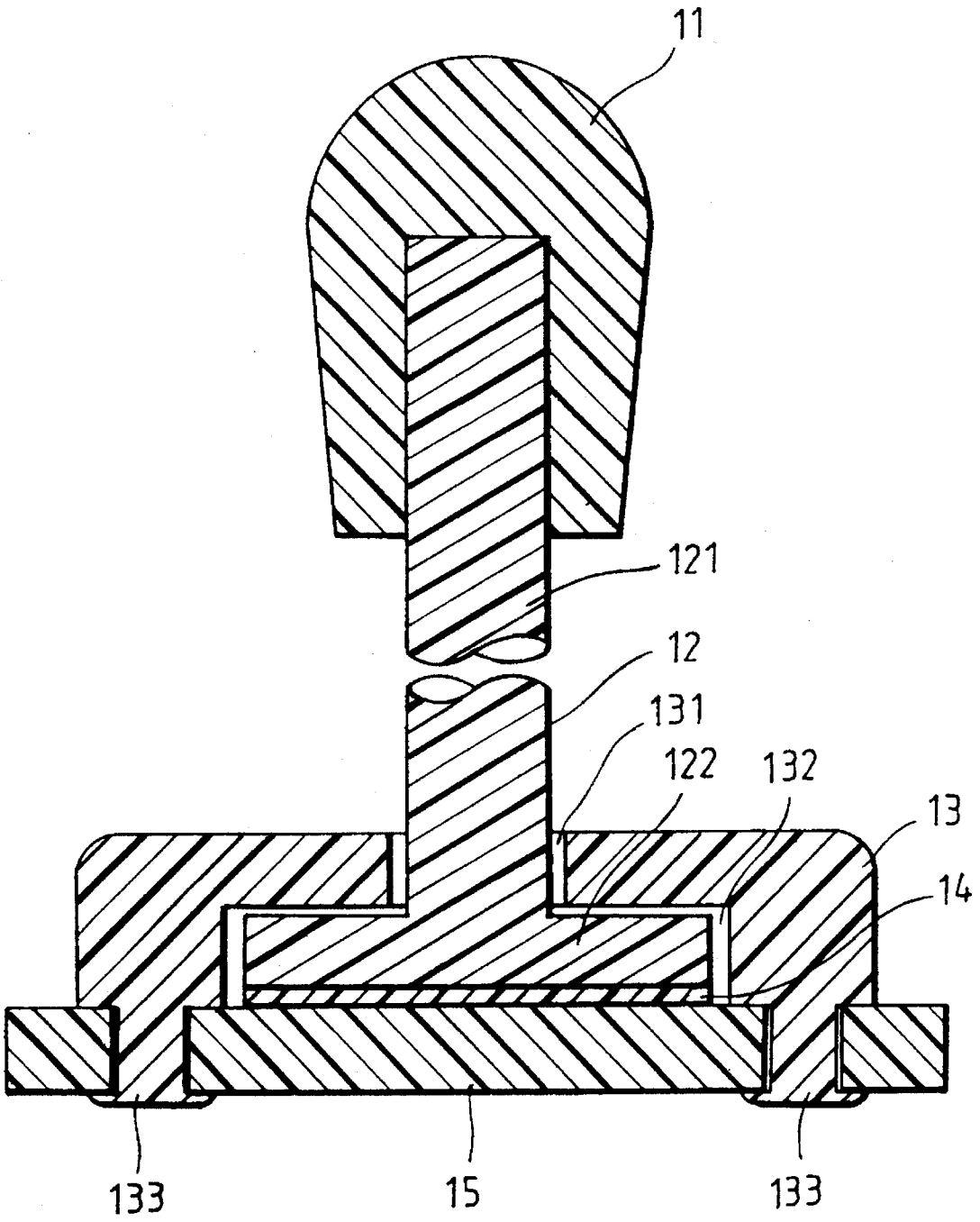
FIG. 1 PRIOR ART
FIG. 1 is a longitudinal view in section of a joystick according to the prior art.
Figure 2:
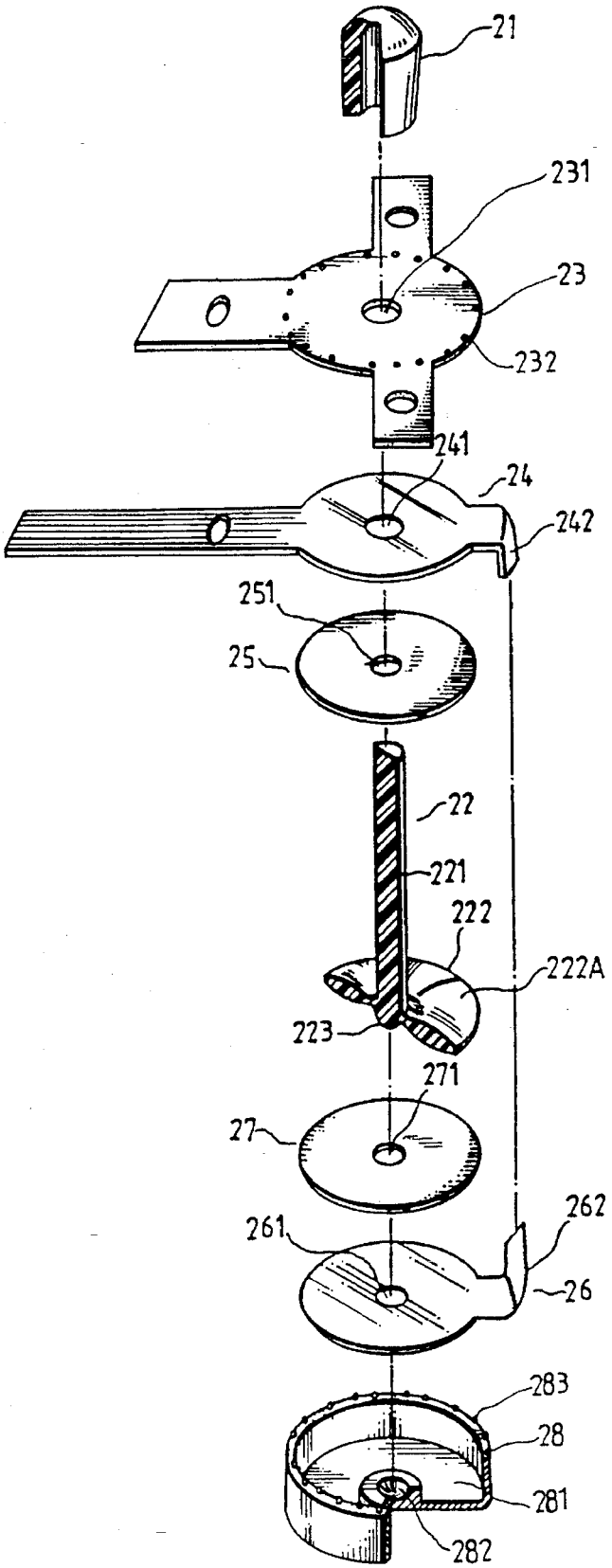
FIG. 2 is an exploded view of a joystick according to the preferred embodiment of the present invention.
Figure 3:
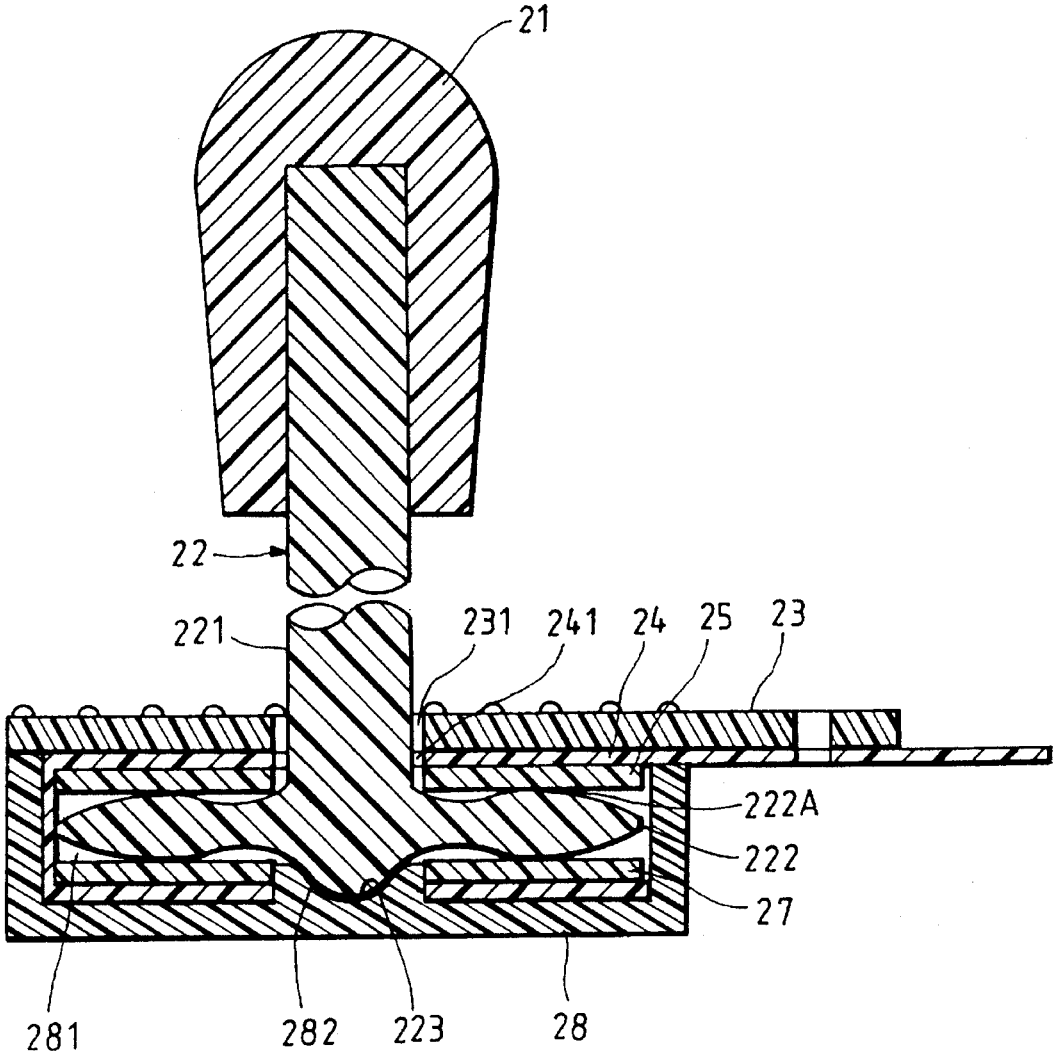
FIG. 3 is a longitudinal view in section of the joystick shown in FIG. 2.

Referring to FIGS. 2 and 3, a joystick switch assembly in accordance with the present invention is generally comprised of a rubber cap 21, a joystick 22, a cover shell 23, an upper membrane circuit 24, an upper conductive rubber 25, a lower membrane circuit 26, a lower conductive rubber 27, and a bottom shell 28. The joystick 22 comprises a joystick body 221 and a contact plate 222 at the bottom of the joystick body 221. The contact plate 222 of the stick 22 comprises two convex portions 222A respectively disposed on two opposite sides thereof, and a bottom stub rod 223 raised from the bottom side thereof in the center. The cover shell 23 comprises a center through hole 231, which receives the joystick body 221 of the joystick 21, and a plurality of recessed holes 232 spaced on the bottom surface thereof around the center through hole 231. The upper membrane circuit 24 has a through hole 241 aligned with the center through hole 231 on the cover shell 23, and an extension portion 242 electrically connected to the lower membrane circuit 26. The lower membrane circuit 26 has a through hole 261 aligned with the through hole 241 on the upper membrane circuit 24, and an extension portion 262 electrically connected to the extension portion 242 of the upper membrane circuit 24. The upper and lower conductive rubbers 25;27 have a respective through hole 251 or 271 aligned with the through holes 241;261 on the upper and lower membrane circuits 24;26. The bottom shell 28 is made of U-shape (or cup-shape) defining a storage chamber 281 and having a recessed bearing block 282 inside the storage chamber 281 which bears against the stub rod 223 of the joystick 22, and a plurality of raised portions 283 spaced around the uppermost edge thereof and respectively fitted into the recessed holes 232 on the cover shell 23. The rubber cap 21 is mounted on the joystick body 221 of the joystick 22 at the top. The joystick body 221 of the joystick 22 is inserted in proper order through the through hole 251 on the upper conductive rubber 25, the through hole 241 on the upper membrane circuit 24, and the center through hole 231 on the cover shell 23. The stub rod 223 of the joystick body 222 of the joystick 22 is inserted through the through hole 271 on the lower conductive rubber 27 and the through hole 261 on the lower membrane circuit 26 and then supported on the recessed bearing block 282 of the bottom shell 28. When assembled, the connecting area between the recessed holes 232 and the raised portions 283 is sealed using an ultrasonic welding process.

Because the stub rod 223 is supported on the recessed bearing block 282, the joystick 22 can be moved fore-and-aft as well as side-to-side. Because the contact plate 222 of the joystick 22 has convex portions 222A on two opposite sides thereof, there are two contact points on the contact plate 222 constantly disposed in contact with the respective impedance point on the upper membrane circuit 24 or the lower membrane circuit 26 when the contact plate 222 is moved in either direction. Therefore, the direction and amount of the movement of the joystick 22 is accurately detected. Further, the membrane circuits and the conductive rubbers have low coefficient of friction, they do not wear off quickly, and therefore the service life of the joystick is prolonged.

While only one embodiment of the present invention has been shown and described, it will be understood that various modifications and changes could be made without departing from the spirit and scope of the invention.

What is claimed is:

1. A joystick switch assembly comprising:

a bottom shell generally having a cup shape which defines a storage chamber, said bottom shell comprising a recessed bearing block on a horizontal bottom wall of the bottom shell and in a radial center of the bottom shell, said bottom shell further comprising a vertical surrounding wall having a plurality of raised portions spaced around an upper edge of the vertical surrounding wall;

a cover shell for covering said bottom shell, said cover shell comprising a center through hole, and a plurality of recessed holes for receiving said raised portions of said bottom shell, said plurality of recessed holes being spaced on a bottom surface of the cover shell around the center through hole;

a joystick extending out of said cover shell through the center through hole of said cover shell, said joystick having a contact plate disposed at a bottom end of the joystick, said contact plate being received within the storage chamber of said bottom shell, said contact plate comprising a centrally located bottom stub rod supported on said recessed bearing block within said storage chamber, said contact plate having a first convex portion disposed at a top of the contact plate, and a second convex portion disposed at a bottom of the contact plate;

an upper membrane circuit mounted around said joystick and disposed between said cover shell and the contact plate of said joystick, said upper membrane circuit having a first plurality of impedance points across which a first set of respective impedances are defined;

an upper conductive rubber mounted around said joystick and disposed between said upper membrane circuit and the contact plate of said joystick;

a lower conductive rubber mounted around said joystick and disposed between said bottom shell and the contact plate of said joystick;

a lower membrane circuit mounted around said joystick and disposed between said bottom shell and said lower conductive rubber, said lower membrane circuit being electrically connected to said upper membrane circuit and having a second plurality of impedance points across which a second set of respective impedances are defined; and wherein when said joystick is moved fore-and-aft and side-to-side, said first and second convex portions of said contact plate are moved to squeeze said upper and lower conductive rubbers respectively, causing said upper and lower conductive rubbers to electrically contact respective ones of said first and second plurality of impedance points on said upper and lower membrane circuits and to vary said first and second sets of impedances in a manner indicative of the amount and direction of the movement of said joystick.

2. The joystick switch assembly of claim 1 further comprising a rubber cap covering a top end of said joystick.

3. The joystick switch assembly of claim 1 wherein said cover shell and said bottom shell are sealed by an ultrasonic welding process.

* * * * *